US012745802B2

(12) United States Patent
Hatton et al.

(10) Patent No.: US 12,745,802 B2
(45) Date of Patent: Sep. 29, 2026

(54) VAPORIZER DEVICE WITH VARIABLE BOOSTER CIRCUIT

(71) Applicant: JUUL Labs, Inc., San Francisco, CA (US)

(72) Inventors: Nicholas J. Hatton, Oakland, CA (US); Immaneni Hiteshwar Rao, Oakland, CA (US)

(73) Assignee: JUUL Labs, Inc., Washington, DC (US)

( * ) Notice: Subject to any disclaimer, the term of this patent is extended or adjusted under 35 U.S.C. 154(b) by 407 days.

(21) Appl. No.: 17/982,161

(22) Filed: Nov. 7, 2022

(65) Prior Publication Data

US 2023/0056548 A1 Feb. 23, 2023

Related U.S. Application Data

(63) Continuation of application No. PCT/US2021/031238, filed on May 7, 2021.
(Continued)

(51) Int. Cl.
*A24F 40/50* (2020.01)
*A24F 40/10* (2020.01)

(52) U.S. Cl.
CPC ..... *A24F 40/50* (2020.01); *A24F 40/10* (2020.01)

(58) Field of Classification Search
CPC ..... A24F 40/50; A24F 40/10; H05B 1/0244; H03C 2200/0045; H03B 2200/0064; H03G 3/3021; H02M 5/00
See application file for complete search history.

(56) References Cited

U.S. PATENT DOCUMENTS 3,271,719 A 9/1966 Ovshinsky
4,947,874 A 8/1990 Brooks et al.
(Continued)

FOREIGN PATENT DOCUMENTS

CN 1548934 A 11/2004
CN 101261163 A 9/2008
(Continued)

OTHER PUBLICATIONS

Byju's, Ohm's Law, Nov. 12, 2016, https://byjus.com/physics/ohms-law/ (Year: 2016).*
(Continued)

*Primary Examiner* — Philip Y Louie
*Assistant Examiner* — Oluwatosin O Diyan
(74) *Attorney, Agent, or Firm* — Mintz Levin Cohn Ferris Glovsky and Popeo, P.C.

(57) ABSTRACT

A vaporization device includes a cartridge having a reservoir that holds a vaporizable material, a heating element, and a wicking element that can draw the vaporizable material to the heating element to be vaporized. The vaporizer cartridge is configured for coupling to a vaporizer device body and containing a vaporizable material. Various embodiments of the vaporizer cartridge are described that include one or more features controlling the delivery of power to a heating element. For example, in order to achieve a target temperature for vaporizing the vaporizable material, the heating element may be powered using a variable boost circuit having a variable output voltage. Alternatively, the heating element may be powered using a current source generating a modulated electrical signal having an adjustable duty cycle. Related systems, methods, and articles of manufacture are also described.

19 Claims, 8 Drawing Sheets

Related U.S. Application Data

(60) Provisional application No. 63/021,609, filed on May 7, 2020.

(56) References Cited

U.S. PATENT DOCUMENTS

| | | | |
|---|---|---|---|
| 5,878,752 | A | 3/1999 | Adams et al. |
| 5,894,394 | A | 4/1999 | Baba et al. |
| 6,155,268 | A | 12/2000 | Takeuchi |
| 7,275,866 | B2 | 10/2007 | Tseng |
| D725,310 | S | 3/2015 | Eksouzian |
| 9,312,687 | B2 | 4/2016 | Xiang |
| 10,912,333 | B2 | 2/2021 | Atkins et al. |
| 11,590,296 | B2 | 2/2023 | Hatton et al. |
| 2003/0033055 | A1 | 2/2003 | McRae et al. |
| 2004/0050382 | A1 | 3/2004 | Goodchild |
| 2004/0081624 | A1 | 4/2004 | Nguyen et al. |
| 2006/0047368 | A1 | 3/2006 | Maharajh et al. |
| 2007/0277816 | A1 | 12/2007 | Morrison et al. |
| 2009/0230117 | A1 | 9/2009 | Fernando et al. |
| 2011/0155153 | A1 | 6/2011 | Thorens et al. |
| 2012/0048266 | A1 | 3/2012 | Alelov |
| 2012/0160251 | A1 | 6/2012 | Hammel et al. |
| 2013/0104916 | A1 | 5/2013 | Bellinger et al. |
| 2013/0192615 | A1 | 8/2013 | Tucker et al. |
| 2014/0007891 | A1 | 1/2014 | Liu |
| 2014/0014126 | A1 | 1/2014 | Peleg et al. |
| 2014/0216484 | A1 | 8/2014 | Liu |
| 2014/0261408 | A1 | 9/2014 | DePiano et al. |
| 2014/0261486 | A1 | 9/2014 | Potter et al. |
| 2014/0270727 | A1 | 9/2014 | Ampolini et al. |
| 2014/0299141 | A1 | 10/2014 | Flick |
| 2014/0334804 | A1 | 11/2014 | Choi |
| 2015/0034104 | A1 | 2/2015 | Zhou |
| 2015/0053214 | A1 | 2/2015 | Alarcon et al. |
| 2015/0136158 | A1 | 5/2015 | Stevens et al. |
| 2015/0164147 | A1 | 6/2015 | Verleur et al. |
| 2015/0196060 | A1 | 7/2015 | Wensley et al. |
| 2015/0208729 | A1 | 7/2015 | Monsees et al. |
| 2015/0216237 | A1 | 8/2015 | Wensley et al. |
| 2015/0237916 | A1 | 8/2015 | Farine et al. |
| 2015/0305409 | A1 | 10/2015 | Verleur et al. |
| 2015/0357608 | A1 | 12/2015 | Huang |
| 2015/0357839 | A1 | 12/2015 | Cai et al. |
| 2015/0359263 | A1 | 12/2015 | Bellinger |
| 2015/0374040 | A1 | 12/2015 | Chen |
| 2016/0021933 | A1 | 1/2016 | Thorens et al. |
| 2016/0057811 | A1 | 2/2016 | Tucker et al. |
| 2016/0174611 | A1 | 6/2016 | Monsees et al. |
| 2016/0255878 | A1 | 9/2016 | Huang et al. |
| 2016/0309786 | A1 | 10/2016 | Holtz et al. |
| 2016/0360786 | A1 | 12/2016 | Bellinger et al. |
| 2017/0027234 | A1 | 2/2017 | Farine et al. |
| 2017/0079327 | A1 | 3/2017 | Wu et al. |
| 2017/0119052 | A1 | 5/2017 | Williams et al. |
| 2017/0196263 | A1 | 7/2017 | Sur et al. |
| 2017/0251725 | A1 | 9/2017 | Buchberger et al. |
| 2017/0280779 | A1 | 10/2017 | Qui et al. |
| 2017/0290371 | A1 | 10/2017 | Davis et al. |
| 2017/0294804 | A1 | 10/2017 | Sur et al. |
| 2017/0302089 | A1 | 10/2017 | Bernauer et al. |
| 2017/0327949 | A1* | 11/2017 | Hidaka ..... G01F 23/26 |
| 2018/0027878 | A1 | 2/2018 | Dendy et al. |
| 2018/0035714 | A1 | 2/2018 | Sur et al. |
| 2018/0041060 | A1 | 2/2018 | Walley et al. |
| 2018/0042306 | A1 | 2/2018 | Atkins et al. |
| 2018/0070635 | A1* | 3/2018 | Litten ..... A24F 40/50 |
| 2018/0070644 | A1 | 3/2018 | Monsees et al. |
| 2018/0084608 | A1 | 3/2018 | Bernauer et al. |
| 2018/0090945 | A1 | 3/2018 | Langlinais et al. |
| 2018/0145374 | A1 | 5/2018 | White et al. |
| 2018/0279685 | A1 | 10/2018 | Mayle et al. |
| 2018/0280637 | A1 | 10/2018 | Mayle et al. |
| 2019/0159523 | A1* | 5/2019 | Qiu ..... A24F 40/40 |
| 2019/0313700 | A1 | 10/2019 | Lord et al. |
| 2019/0373679 | A1 | 12/2019 | Fu et al. |
| 2019/0387795 | A1 | 12/2019 | Fisher et al. |
| 2020/0000146 | A1 | 1/2020 | Anderson et al. |
| 2020/0037668 | A1 | 2/2020 | Robert et al. |
| 2020/0046033 | A1 | 2/2020 | Robert et al. |
| 2023/0047657 | A1 | 2/2023 | Harrison et al. |
| 2024/0050671 | A1 | 2/2024 | Sur |
| 2024/0245109 | A1 | 7/2024 | Harrison et al. |

FOREIGN PATENT DOCUMENTS

| | | | | |
|---|---|---|---|---|
| CN | 101419098 | A | 4/2009 | |
| CN | 101653354 | A | 2/2010 | |
| CN | 101806640 | A | 8/2010 | |
| CN | 202760174 | U | 3/2013 | |
| CN | 103777670 | A | 5/2014 | |
| CN | 103859604 | A | 6/2014 | |
| CN | 103912429 | A | 7/2014 | |
| CN | 203873004 | U | 10/2014 | |
| CN | 104142463 | A | 11/2014 | |
| CN | 105011375 | A | 11/2015 | |
| CN | 105209873 | A | 12/2015 | |
| CN | 204905326 | U | 12/2015 | |
| CN | 106579560 | A | 4/2017 | |
| CN | 105011375 | B | 12/2017 | |
| CN | 206714080 | U | 12/2017 | |
| CN | 108463127 | A | 8/2018 | |
| CN | 108940704 | A * | 12/2018 | ..... A61M 11/005 |
| CN | 208490842 | U * | 2/2019 | ..... A24F 40/40 |
| CN | 109588779 | A | 4/2019 | |
| EP | 2895930 | A2 | 7/2015 | |
| EP | 3092909 | A1 | 11/2016 | |
| EP | 2959787 | B1 | 4/2021 | |
| EP | 3871539 | A1 | 9/2021 | |
| JP | 2013113551 | A | 6/2013 | |
| JP | 2014530632 | A | 11/2014 | |
| JP | 2018505696 | A | 3/2018 | |
| KR | 101162688 | B1 | 7/2012 | |
| KR | 10-2015-0064754 | A | 6/2015 | |
| KR | 10-2017-0137066 | A | 12/2017 | |
| RU | 2643422 | C2 | 2/2018 | |
| RU | 2646737 | C2 | 3/2018 | |
| RU | 2654619 | C1 | 5/2018 | |
| SG | 11201707778 | W | 10/2017 | |
| TW | 200922096 | A | 5/2009 | |
| TW | 201620405 | A | 6/2016 | |
| WO | WO-2011137453 | A2 | 11/2011 | |
| WO | WO-2012085207 | A1 | 6/2012 | |
| WO | WO-2012120487 | A2 | 9/2012 | |
| WO | WO-2013060781 | A1 | 5/2013 | |
| WO | WO-2013120565 | A2 | 8/2013 | |
| WO | WO-2014040988 | A1 | 3/2014 | |
| WO | WO-2014102091 | A1 | 7/2014 | |
| WO | WO-2014166121 | A1 | 10/2014 | |
| WO | WO-2015071682 | A1 | 5/2015 | |
| WO | WO-2015100361 | A1 | 7/2015 | |
| WO | WO-2018122411 | A1 | 7/2015 | |
| WO | WO-2015165747 | A1 | 11/2015 | |
| WO | WO-2016101200 | A1 | 6/2016 | |
| WO | WO-2017020220 | A1 | 2/2017 | |
| WO | WO-2017072705 | A2 | 5/2017 | |
| WO | WO-2017085242 | A1 | 5/2017 | |
| WO | WO-2018055761 | A1 | 3/2018 | |
| WO | WO-2018094418 | A1 | 5/2018 | |
| WO | WO-2018107494 | A1 * | 6/2018 | |
| WO | WO-2018153171 | A1 | 8/2018 | |
| WO | WO-2018202403 | A1 | 11/2018 | |
| WO | WO-2019105879 | A1 * | 6/2019 | ..... A24F 40/30 |
| WO | WO-2020006305 | A1 | 1/2020 | |
| WO | WO-2020084756 | A1 | 4/2020 | |
| WO | WO-2020085365 | A1 * | 4/2020 | ..... A24F 40/57 |

OTHER PUBLICATIONS

English Machine Translation for CN 108940704 A (Year: 2018).*
English Machine Translation for CN 208490842 U (Year: 2019).*
English Machine Translation for WO 2018107494 A1 (Year: 2018).*
English Machine Translation for WO 2020085365 A1 (Year: 2020).*
PCT/US2021/031238, May 7, 2021, WO 2021226427.

(56) References Cited

OTHER PUBLICATIONS (Jun. 15, 2021) How to Measure Resistance—Hioki, https://www.hioki.com/en/learning/methods/resistancemeasurement-methods.html/.
Low Level Measurements Handbook—7th Edition Precision DC Current, Voltage, and Resistance Measurements.
(Jun. 15, 2021) Resistance thermometer, https://en.wikipedia.org/wiki/Resistance_thermometer.
(Jun. 15, 2021) Room temperature, https://en.wikipedia.org/wiki/Room_temperature.
Dittmer, Greg (2008) Synchronous Boost Converters Provide High Voltage without the Heat, Linear technology magazine, 19-37 pages.
Tony R. Kuphaldt (2006) "Temperature coefficient of resistance", Lessons in Electric Circuits, vol. 1 DC, section 12.6.
(Sep. 2011) Linear Technology Data Sheet and Product Info for LTC3786 Low IQ Synchronous Boost Controller, Revision A, Available online at: https://cdn.ozdisan.com/ETicaret_Dosya/482058_5551574.pdf, 34 pages.

* cited by examiner

VAPORIZER DEVICE WITH VARIABLE BOOSTER CIRCUIT

CROSS REFERENCE TO RELATED APPLICATION

This application is a bypass continuation and claims priority to PCT/US2021/031238, filed on May 7, 2021 and entitled "VAPORIZER DEVICE WITH VARIABLE BOOSTER CIRCUIT," which claims priority to U.S. Provisional Application No. 63/021,609, filed on May 7, 2020 and entitled "VAPORIZER DEVICE WITH VARIABLE BOOSTER CIRCUIT," the disclosures of which are incorporated herein by reference in their entirety.

TECHNICAL FIELD

The subject matter described herein relates generally to vaporizer devices and more specifically to controlling the delivery of power to a heating element in a vaporizer device.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer can be provided within a cartridge (for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

In some implementations, the vaporizable material can be drawn out of a reservoir and into the vaporization chamber via a wicking element (e.g., a wick). Drawing of the vaporizable material into the vaporization chamber can be at least partially due to capillary action provided by the wick as the wick pulls the vaporizable material along the wick in the direction of the vaporization chamber.

Vaporizer devices can be controlled by one or more controllers, electronic circuits (for example, sensors, heating elements), and/or the like on the vaporizer. Vaporizer devices can also wirelessly communicate with an external controller (for example, a computing device such as a smartphone).

SUMMARY

In certain aspects of the current subject matter, challenges associated with delivering power to a heating element in a vaporizer device can be addressed by inclusion of one or more of the features described herein or comparable/equivalent approaches as would be understood by one of ordinary skill in the art. Aspects of the current subject matter relate to systems and methods for delivering power to a heating element in a vaporizer device.

In one aspect, there is provided a vaporizer device including a power source, a variable boost circuit, and a controller. The variable boost circuit may have a bypass mode and a non-bypass mode. The variable boost circuit in the bypass mode may be configured to deliver power from the power source to a heating element by generating a first output voltage corresponding to a voltage of the power source. The variable boost circuit in the non-bypass mode may be configured to deliver power from the power source to the heating element by generating a second output voltage greater than the voltage of the power source. The delivery of power to the heating element may increase a temperature of the heating element to a target temperature for vaporizing a vaporizable material. The controller may be configured to determine, based at least on one or more measurements associated with the heating element, whether to operate the variable boost circuit in the bypass mode or the non-bypass mode.

In some variations, one or more features disclosed herein including the following features can optionally be included in any feasible combination. The controller may be further configured to respond to determining to operate the variable boost circuit in the bypass mode by at least adjusting a duty cycle at which the first output voltage is applied at the heating element.

In some variations, the controller may determine, based at least on a duty cycle of a modulated electrical signal that causes a target power level to be delivered from the power source to the heating element, whether to operate the variable boost circuit in the bypass mode or the non-bypass mode.

In some variations, the controller may determine to operate the variable boost circuit in the non-bypass mode when the duty cycle exceeds a threshold percentage. The controller may determine to operate the variable boost circuit in the bypass mode when the duty cycle does not exceed the threshold percentage.

In some variations, the controller may be configured to determine, based at least on a difference between a current temperature of the heating element and the target temperature of the heating element, the target power level. The controller may be further configured to determine, based at least on the target power level, the duty cycle of the modulated electrical signal.

In some variations, the controller may be further configured to determine, based at least on a resistance of the heating element, the current temperature of the heating element.

In some variations, the controller may be configured to determine, based at least on a magnitude of a current applied across the heating element and a voltage across the heating element when the current is applied across the heating element, the resistance of the heating element.

In some variations, the vaporizer device may further include a current source configured to provide, to the heating element, the current having a known magnitude.

In some variations, the controller may be further configured to disable the variable boost circuit while performing the one or more measurements to determine the magnitude of the current applied across the heating element and/or the voltage across the heating element.

In some variations, the controller may be further configured to generate a control signal configured to place the variable boost circuit in the bypass mode or the non-bypass mode by at least adjusting an output voltage of the variable boost circuit.

In some variations, the variable boost circuit may include a feedback node. The control signal may include a pulse width modulated (PWM) signal applied at the feedback node of the variable boost circuit. The controller may adjust the output voltage of the variable boost circuit by at least adjusting a duty cycle of the control signal.

In some variations, the controller may increase the duty cycle of the control signal in order to decrease the output voltage of the variable boost circuit. The controller may decrease the duty cycle of the control signal in order to increase the output voltage of the variable boost circuit.

In some variations, the control signal may be passed through a low-pass filter before being applied at the feedback node of the variable boost circuit.

In some variations, the variable boost circuit in the non-bypass mode may be further configured to deliver power from the power source to the heating element by generating a third output voltage greater than the voltage of the power source.

In some variations, the power source may include a battery.

In some variations, the vaporizable material may be included in a reservoir disposed in a vaporizer cartridge. The vaporizer cartridge may be configured to couple with a body of the vaporizer device.

In some variations, the heating element may be disposed in the vaporizer cartridge or in the body of the vaporizer device.

In another aspect, there is provided a method that includes: determining, based at least on one or more measurements associated with a heating element of a vaporizer device, whether to operate a variable boost circuit in the vaporizer device in a bypass mode or a non-bypass mode; in response to determining to operate the variable boost circuit in the bypass mode, delivering, by the variable boost circuit, power from a power source in the vaporizer device to the heating element by generating a first output voltage corresponding to a voltage of the power source; and in response to determining to operate the variable boost circuit in the non-bypass mode, delivering, by the variable boost circuit, power from the power source to the heating element by generating a second output voltage greater than the voltage of the power source, the delivery of power to the heating element increasing a temperature of the heating element to a target temperature for vaporizing a vaporizable material.

In some variations, one or more features disclosed herein including the following features can optionally be included in any feasible combination. The method may further include adjusting a duty cycle at which the first output voltage is applied at the heating element in response to determining to operate the variable boost circuit in the bypass mode.

In some variations, the method may further include determining, based at least on a duty cycle of a modulated electrical signal that causes a target power level to be delivered from the power source to the heating element, whether to operate the variable boost circuit in the bypass mode or the non-bypass mode.

In some variations, the method may further include: determining to operate the variable boost circuit in the non-bypass mode when the duty cycle exceeds a threshold percentage; and determining to operate the variable boost circuit in the bypass mode when the duty cycle does not exceed the threshold percentage.

In some variations, the method may further include: determining, based at least on a difference between a current temperature of the heating element and the target temperature of the heating element, the target power level; and determining, based at least on the target power level, the duty cycle of the modulated electrical signal.

In some variations, the method may further include determining, based at least on a resistance of the heating element, the current temperature of the heating element.

In some variations, the method may further include determining, based at least on a magnitude of a current applied across the heating element and a voltage across the heating element when the current is applied across the heating element, the resistance of the heating element.

In some variations, the method may further include providing, by a current source, the current having a known magnitude to the heating element.

In some variations, the method may further include disabling the variable boost circuit while performing the one or more measurements to determine the magnitude of the current applied across the heating element and/or the voltage across the heating element.

In some variations, the method may further include generating a control signal configured to place the variable boost circuit in the bypass mode or the non-bypass mode by at least adjusting an output voltage of the variable boost circuit.

In some variations, the variable boost circuit may include a feedback node. The control signal may include a pulse width modulated (PWM) signal applied at the feedback node of the variable boost circuit. The output voltage of the variable boost circuit may be adjusted by at least adjusting a duty cycle of the control signal.

In some variations, the method may further include: increasing the duty cycle of the control signal in order to decrease the output voltage of the variable boost circuit; and decreasing the duty cycle of the control signal in order to increase the output voltage of the variable boost circuit.

In some variations, the control signal may be passed through a low-pass filter before being applied at the feedback node of the variable boost circuit.

In some variations, the variable boost circuit in the non-bypass mode may be further configured to deliver power from the power source to the heating element by generating a third output voltage greater than the voltage of the power source.

In some variations, the power source may include a battery.

In some variations, the vaporizable material may be included in a reservoir disposed in a vaporizer cartridge configured to couple with a body of the vaporizer device.

In some variations, the heating element may be disposed in the vaporizer cartridge or in the body of the vaporizer device.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1A:
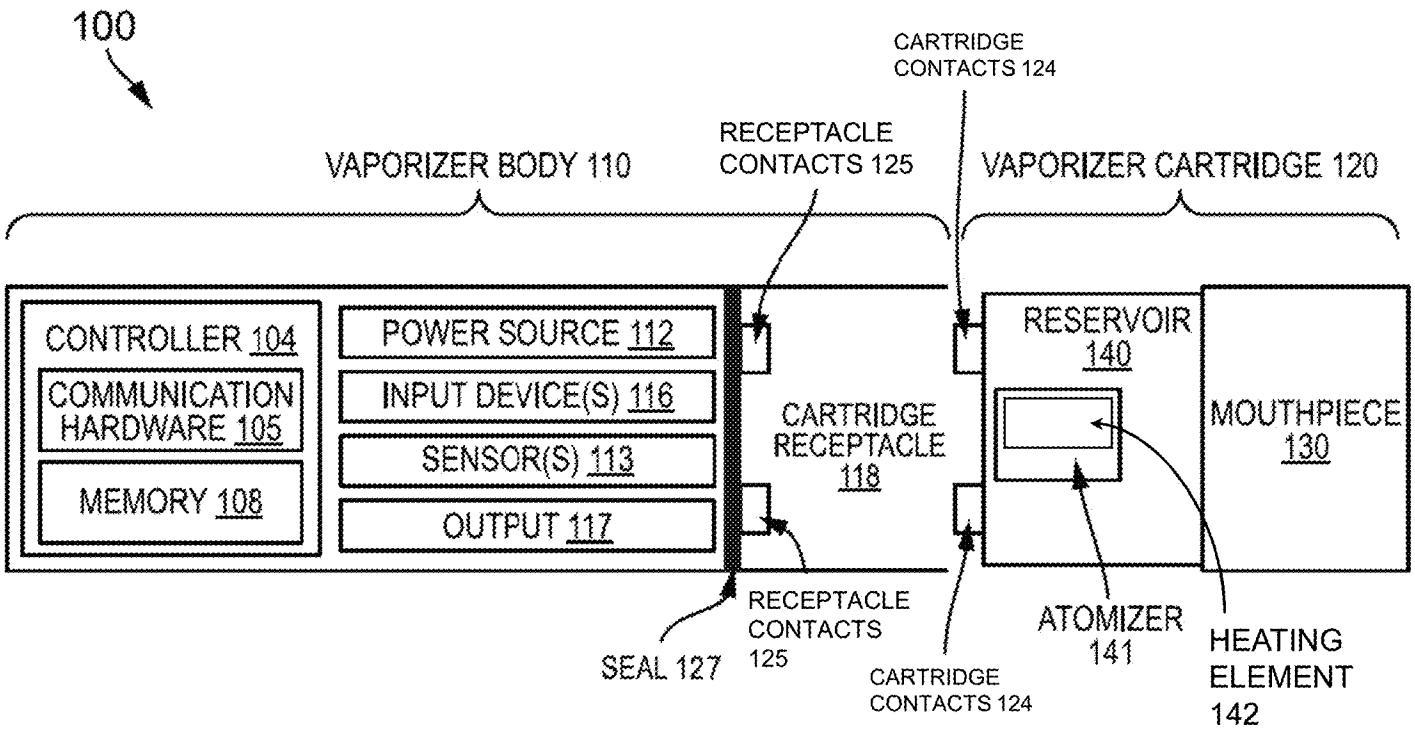
FIG. 1A depicts a block diagram illustrating an example of a vaporizer device consistent with implementations of the current subject matter.

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material. The vaporizable material used with a vaporizer device can be provided within a cartridge (for example, a part of the vaporizer that contains the vaporizable material in a reservoir or other container) which can be refillable when empty, or disposable such that a new cartridge containing additional vaporizable material of a same or different type can be used.

A vaporizer device can be a cartridge-using vaporizer device, a cartridge-less vaporizer device, or a multi-use vaporizer device capable of use with or without a cartridge. For example, a vaporizer device can include a heating chamber (for example, an oven or other region in which material is heated by a heating element) configured to receive a vaporizable material directly into the heating chamber, and/or a reservoir or the like for containing the vaporizable material. In some implementations, a vaporizer device can be configured for use with a liquid vaporizable material (for example, a carrier solution in which an active and/or inactive ingredient(s) are suspended or held in solution, or a liquid form of the vaporizable material itself), a paste, a wax, and/or a solid vaporizable material. A solid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

To vaporize a vaporizable material, the vaporizer device may be required to deliver power from a power source (e.g., a battery and/or the like) to a heating element at a high rate in order to increase and/or maintain the temperature of the heating element. For example, a high power level may be required due to the high resistance of the heating element. Moreover, additional power may be necessary in instances where the vaporizer device is required to increase the temperature of the heating element at a rapid rate. However, the level of power that is delivered to the heating element may be limited, for example, by the impedance associated with the power source as well as the losses incurred along the path between the heating element and the power source. The ability to deliver sufficient power to the heating element may also diminish as the voltage of the power source decreases, for example, below a threshold. Accordingly, in some implementations of the current subject matter, a vaporizer device may include a boost circuit configured to increase the voltage of the power source such that a sufficient level of power is delivered to the heating element.

In some implementations of the current subject matter, the vaporizer device may include a variable boost circuit having a variable output voltage. For example, the variable boost circuit may be configured to provide multiple different output voltages, each of which being greater than the voltage of the power source (e.g., a battery and/or the like). Due to variations in the resistance of the heating element, the vaporizer device may include the variable boost circuit, instead of a boost circuit that provides a fixed output voltage. For example, variations in the resistance of the heating element may be introduced during manufacturing as well as over the course of use of the vaporizer device. A fixed boost circuit, which provides a fixed output voltage, may deliver inadequate power to a high-resistance heating element or excess power to a low-resistance heating element. Contrastingly, the output voltage of the variable boost circuit may be adjusted in order to deliver, to the heating element, a level of power that corresponds the power requirement and the resistance of the heating element.

In some implementations of the current subject matter, the vaporizer device may operate the variable boost circuit in a bypass mode and deliver power to the heating element by applying, to the heating element, an unboosted, modulated electrical signal (e.g., a pulse width modulated electrical signal and/or the like) from the power source. The vaporizer device may determine whether to operate the variable boost circuit in the bypass mode based on a duty cycle of the modulated electrical signal that causes a target power level to be delivered from the power source to the heating element. For example, the vaporizer device may operate the variable boost circuit in the bypass mode if the duty cycle of the modulated electrical signal causing the power source to deliver the target power level to the heating element does not exceed a threshold percentage (e.g., 100%). Alternatively, the vaporizer device may operate the variable boost circuit in a non-bypass mode if the duty cycle of the modulated electrical signal causing the power source to deliver the target power level to the heating element exceeds the threshold percentage.

The vaporizer device may determine the duty cycle of the modulated electrical signal that causes the target power level to be delivered from the power source to the heating element based at least on a current temperature of the heating element and a target temperature of the heating element. For example, the current temperature of the heating element may be determined based on one or more measurements associated with the heating element including, for example, a voltage, a current, a resistance, and/or the like. The vaporizer device may determine, based at least on a magnitude of the difference between the current temperature of the heating element and the target temperature for the heating element, the target power level required for achieving the target temperature, for example, within a threshold quantity of time. Moreover, the vaporizer device may determine, based at least on the target power level, the duty cycle of the modulated electrical signal that causes the target power level to be delivered from the power source to the heating element.

FIG. 1A depicts a block diagram illustrating an example of a vaporizer device 100 consistent with implementations of the current subject matter. Referring to FIG. 1A, the vaporizer device 100 can include a power source 112 (for example, a battery, which can be a rechargeable battery), and a controller 104 (for example, a processor, circuitry, etc. capable of executing logic) for controlling delivery of heat to an atomizer 141 to cause a vaporizable material 102 to be converted from a condensed form (such as a solid, a liquid, a solution, a suspension, a part of an at least partially unprocessed plant material, etc.) to the gas phase.

The controller 104 can be part of one or more printed circuit boards (PCBs) consistent with certain implementations of the current subject matter. After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer 141 in the vaporizer device 100 can be configured to vaporize a vaporizable material 102. The vaporizable material 102 can be a liquid. Examples of the vaporizable material 102 include neat liquids, suspensions, solutions, mixtures, and/or the like. The atomizer 141 can include a wicking element (e.g., a wick) configured to convey an amount of the vaporizable material 102 to a part of the atomizer 141 that includes a heating element 142.

For example, the wicking element can be configured to draw the vaporizable material 102 from a reservoir 140 configured to contain the vaporizable material 102, such that the vaporizable material 102 can be vaporized by heat generated by a heating element 142. The wicking element can also optionally allow air to enter the reservoir 140 and replace the volume of vaporizable material 102 removed. In some implementations of the current subject matter, capillary action can pull vaporizable material 102 into the wick for vaporization by the heating element 142, and air can return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The heating element can include one or more of a conductive heater, a radiative heater, a convective heater, and/or the like. In some implementations of the current subject matter, the heating element 142 may be a resistive heating element, which can include a material (such as a metal or alloy, for example a nickel-chromium alloy, or a non-metallic resistor) configured to dissipate electrical power in the form of heat when electrical current is passed through one or more resistive segments of the heating element 142. The atomizer 141 can include the heating element 142, which may include a resistive coil or other heating element wrapped around, positioned within, integrated into a bulk shape of, pressed into thermal contact with, or otherwise arranged to deliver heat to the wicking element, to cause the vaporizable material 102 drawn from the reservoir 140 by the wicking element to be vaporized for subsequent inhalation by a user in a gas and/or a condensed (for example, aerosol particles or droplets) phase. Other wicking elements, heating elements, and/or atomizer assembly configurations are also possible.

The vaporizer device 100 can be configured, as noted, to create an inhalable dose of the vaporizable material 102 in the gas phase and/or aerosol phase via heating of the vaporizable material 102. The vaporizable material 102 can be a solid-phase material (such as a wax or the like) or plant material (for example, tobacco leaves and/or parts of tobacco leaves). In such vaporizer devices, the heating element 142 (e.g., a resistive heating element and/or the like) can be part of, or otherwise incorporated into or in thermal contact with, the walls of an oven or other heating chamber into which the vaporizable material 102 is placed. Alternatively, the heating element 142 can be used to heat air passing through or past the vaporizable material 102, to cause convective heating of the vaporizable material 102. In still other examples, the heating element 142 can be disposed in intimate contact with plant material such that direct conductive heating of the plant material occurs from within a mass of the plant material, as opposed to only by conduction inward from walls of an oven.

The heating element 142 can be activated in response to a user puffing (e.g., drawing, inhaling, and/or the like.) on a mouthpiece 130 of the vaporizer device 100 to cause air to flow from an air inlet, along an airflow path that passes the atomizer 141 (e.g., wicking element and heating element). Optionally, air can flow from an air inlet through one or more condensation areas or chambers, to an air outlet in the mouthpiece 130. Incoming air moving along the airflow path moves over or through the atomizer 141, where vaporizable material 102 in the gas phase is entrained into the air. The heating element 142 can be activated via the controller 104, which can optionally be a part of a vaporizer body 110 as discussed herein, causing current to pass from the power source 112 through a circuit including the heating element 142. Although shown as a part of a vaporizer cartridge 120 in FIG. 1A, it should be appreciated that the at least a portion of the atomizer 141 including the heating element 142 may also be disposed in the vaporizer body 110. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element 142 can be caused by an automatic detection of a puff based on one or more signals generated by one or more of a sensor 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical interface controls (e.g., physical buttons) or virtual interface controls (e.g., user interface elements configurable on a screen or other display device and selectable via user interaction with a touch-sensitive screen or another input device, such as a mouse, pointer, trackball, cursor buttons, camera, or the like). The vaporizer device 100 can also include one or more output devices 117 for providing information to the user. For example, the output devices 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of the heating element 142 of the vaporizer device 100 can depend on a number of factors including, for example, a quantity of electrical power delivered to the heating element 142, conductive heat transfer to other parts of the electronic vaporizer device 100 and/or to the environment, latent heat losses due to vaporization of the vaporizable material 102 from the wicking element and/or the atomizer 141 as a whole, and convective heat losses due to airflow (e.g., air moving across the heating element or the atomizer 141 as a whole when a user inhales on the vaporizer device 100). As noted herein, to reliably activate the heating element 142 or heat the heating element 142 to a target temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element 142 can be activated in response to a user's puff, which may be detected by the sensor 113 based on a change (such as a pressure change) in the airflow path.

The sensor 113 can be positioned on or coupled to (e.g., electrically or electronically connected, either physically or via a wireless connection) the controller 104 (e.g., a printed circuit board assembly or another type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path. In an example of a cartridge-based vaporizer, the seal 127 can also separate parts of one or more electrical connections between the vaporizer body 110 and the vaporizer cartridge 120. Such arrangements of the seal 127 in the vaporizer device 100 can be helpful in mitigating against potentially disruptive impacts on vaporizer components resulting from interactions with environmental factors such as water in the vapor or liquid phases, other fluids such as the vaporizable material 102, etc., and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc., in parts of the vaporizer device 100 where they can result in poor pressure signal, degradation of the sensor 113 or other components, and/or a shorter life of the vaporizer device 100. Leaks in the seal 127 can also result in a user inhaling air that has passed over parts of the vaporizer device 100 containing, or constructed of, materials that may not be desirable to be inhaled.

In some implementations, the vaporizer body 110 includes the controller 104, the power source 112 (for example, a battery), one more of the sensor 113, charging contacts (such as those for charging the power source 112), the seal 127, and a cartridge receptacle 118 configured to receive the vaporizer cartridge 120 for coupling with the vaporizer body 110 through one or more of a variety of attachment structures. In some examples, the vaporizer cartridge 120 includes the reservoir 140 for containing the vaporizable material 102, and the mouthpiece 130 has an aerosol outlet for delivering an inhalable dose to a user. The vaporizer cartridge 120 can include the atomizer 141 having a wicking element and the heating element 142. Alternatively, one or both of the wicking element and the heating element 142 can be part of the vaporizer body 110. In implementations in which any part of the atomizer 141 (e.g., the heating element 142 and/or wicking element) is part of the vaporizer body 110, the vaporizer device 100 can be configured to supply the vaporizable material 102 from the reservoir 140 in the vaporizer cartridge 120 to one or more parts of the atomizer 141 included in the vaporizer body 110.

Cartridge-based configurations for the vaporizer device 100 that generate an inhalable dose of a vaporizable material 102 that is not a liquid, via heating of a non-liquid material, are also within the scope of the current subject matter. For example, the vaporizer cartridge 120 can include a mass of a plant material that is processed and formed to have direct contact with parts of the heating element 142, and the vaporizer cartridge 120 can be configured to be coupled mechanically and/or electrically to the vaporizer body 110 that includes the controller 104, the power source 112, and one or more receptacle contacts 125 configured to connect to one or more corresponding cartridge contacts 124 and complete a circuit with the heating element 142. In some implementations of the current subject matter, the one or more receptacle contacts 125 may include two contacts configured to couple with a corresponding quantity of cartridge contacts 124. Alternatively, the one or more receptacle contacts 125 may include four contacts configured to couple with a corresponding quantity of cartridge contacts 124.

In an embodiment of the vaporizer device 100 in which the power source 112 is part of the vaporizer body 110, and the heating element 142 is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element 142. These features can include the one or more cartridge contacts 124 on a bottom surface of the vaporizer cartridge 120 and as the one or more receptacle contacts 125 disposed near a base of the cartridge receptacle 118 of the vaporizer device 100 such that the cartridge contacts 124 and the receptacle contacts 125 make electrical connections when the vaporizer cartridge 120 is inserted into and coupled with the cartridge receptacle 118. The circuit completed by these electrical connections can allow delivery of electrical current to the heating element 142 and can further be used for additional functions including, for example, measuring a current, voltage, and/or resistance of the heating element 142 for use in determining and/or controlling a temperature of the heating element 142 based on a thermal coefficient of resistivity of the heating element 142.

In some implementations of the current subject matter, the cartridge contacts 124 and the receptacle contacts 125 can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) as well as in a second rotational orientation.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110), the detents or protrusions of the vaporizer body 110 can fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124 and the receptacle contacts 125, while allowing release of the vaporizer cartridge 120 from the vaporizer body 110 when a user pulls with reasonable force on the vaporizer cartridge 120 to disengage the vaporizer cartridge 120 from the cartridge receptacle 118.

In some implementations of the current subject matter, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the shape of the non-circular cross section can be approximately rectangular, approximately elliptical (e.g., oval), non-rectangular but with two sets of parallel or approximately parallel opposing sides (i.e., a parallelogram), or another shape having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124 and the receptacle contacts 125 can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Figure 1B:
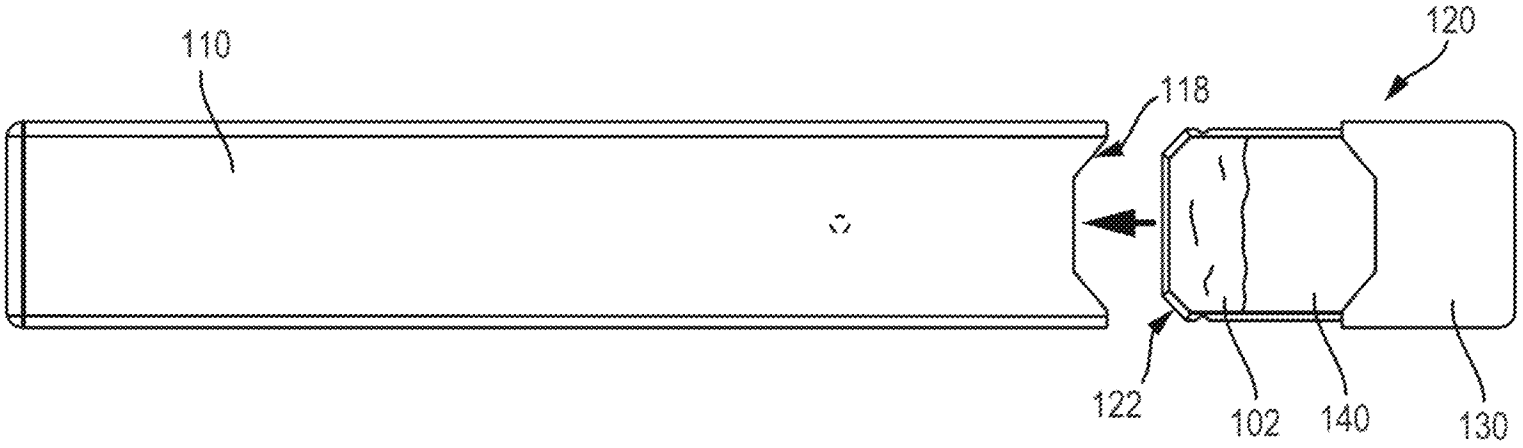
FIG. 1B depicts a top view of an example of a vaporizer device including a vaporizer cartridge consistent with implementations of the current subject matter.

FIG. 1B depicts a top view of an example of the vaporizer device 100 including the vaporizer cartridge 120 consistent with implementations of the current subject matter. As shown in FIG. 1B, the vaporizer body 110 can include the cartridge receptacle 118 into which the vaporizer cartridge 120 can be releasably inserted. When a user puffs on the vaporizer device 100, air can pass between an outer surface of the vaporizer cartridge 120 and an inner surface of the cartridge receptacle 118 on the vaporizer body 110. Air can then be drawn into the insertable end 122 of the cartridge, through the vaporization chamber that includes or contains the heating element and wick, and out through an outlet of the mouthpiece 130 for delivery of the inhalable aerosol to a user. The reservoir 140 of the vaporizer cartridge 120 can be formed in whole or in part from translucent material such that a level of the vaporizable material 102 is visible within the vaporizer cartridge 120. The mouthpiece 130 can be a separable component of the vaporizer cartridge 120 or can be integrally formed with other component(s) of the vaporizer cartridge 120 (for example, formed as a unitary structure with the reservoir 140 and/or the like). The vaporizer cartridge 120 can also include a cannula running through the reservoir 140 from the atomizer 141 to the mouthpiece 130 of the vaporizer cartridge 120. Air can flow into the vaporizer cartridge 120, through the cannula, and out the mouthpiece 130 to the user. In some embodiments, the vaporizer cartridge 120 can include a gasket configured to provide a seal between the atomizer 141 and the reservoir 140 and the cannula. Additionally and/or alternatively, the cannula can be in fluid communication with the atomizer 141 and a condensation chamber, to deliver the vaporizable material 102 from the atomizer 141 to the condensation chamber. The condensation chamber can be in fluid communication with the atomizer 141 and configured to generate an aerosol from the vaporizable material 102.

Further to the discussion above regarding the electrical connections between the vaporizer cartridge 120 and the vaporizer body 110 being reversible such that at least two rotational orientations of the vaporizer cartridge 120 in the cartridge receptacle 118 are possible, in some embodiments of the vaporizer device 100, the shape of the vaporizer cartridge 120, or at least a shape of the insertable end 122 of the vaporizer cartridge 120 that is configured for insertion into the cartridge receptacle 118, can have rotational symmetry of at least order two. In other words, the vaporizer cartridge 120 or at least the insertable end 122 of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

To vaporize the vaporizable material 102, the vaporizer device 100 may be required to deliver, at a high rate, power from the power source 112 (e.g., a battery and/or the like) to the heating element 142. The power delivered to the heating element 142 may increase and/or maintain the temperature of the heating element 142, for example, at a target temperature for vaporizing the vaporizable material 102. For example, in some implementations of the current subject matter, the vaporizer device 100 may include a variable boost circuit whose output voltage may be adjusted in order to deliver, to the heating element 142, a level of power that corresponds to the power requirement and the resistance of the heating element 142. For example, the high resistance of the heating element 142 may necessitate power to be delivered from the power source 112 at a high rate. Moreover, additional power may be necessary in instances where the vaporizer device 100 is required to increase the temperature of the heating element 142 at a rapid rate.

Due to variations in the resistance of the heating element 142, the vaporizer device 100 may include the variable boost circuit instead of a boost circuit that provides a fixed output voltage. For example, a boost circuit providing a fixed output voltage may deliver inadequate power to the heating element 142 when the resistance of the heating element 142 is high or excess power to the heating element 142 when the resistance of the heating element 142 is low. Contrastingly, by having an adjustable output voltage, the variable boost circuit may be capable of delivering, to the heating element 142, a power level that corresponds to the resistance and/or the power requirement of the heating element 142. For example, the variable boost circuit may step up the voltage of the power source 112 in order to deliver, to the heating element 142, a power level that corresponds to the resistance and/or the power requirement of the heating element 142. By stepping up the voltage of the power source 112 while stepping down the current discharged from the power source 112, the variable boost circuit may reduce resistive loss in the system. In particular, the variable boost circuit may operate to minimize the dissipation of power before power from the power source 112 reaches the heating element 142.

In some implementations of the current subject matter, the vaporizer device 100 may operate the variable boost circuit in a bypass mode and deliver power to the heating element 142 by applying, to the heating element 142, a modulated electrical signal (e.g., a pulse width modulated electrical signal and/or the like) from the power source 112 (e.g., a battery and/or the like) that is not subject to a boost from the variable boost circuit. Accordingly, when the variable boost circuit is operating in the bypass mode, the output voltage of the variable boost circuit may correspond to the voltage of the power source 112. Alternatively, the vaporizer device 100 may operate the variable boost circuit in a non-bypass mode in which the variable boost circuit provides, to the heating element 142, a variable output voltage that is higher than the voltage of the power source 112.

The vaporizer device 100, for example, the controller 104, may determine whether to operate the variable boost circuit in the bypass mode or the non-bypass mode based on a duty cycle of the modulated electrical signal that causes a target power level to be delivered from the power source 112 to the heating element 142. For example, the controller 104 may determine to operate the variable boost circuit in the bypass mode if the duty cycle of the modulated electrical signal that causes the power source 112 to deliver the target power level to the heating element 142 does not exceed a threshold percentage (e.g., duty cycle ≤100%). Alternatively, the controller 104 may determine to operate the variable boost circuit in the non-bypass mode if the duty cycle of the modulated electrical signal that causes the power source 112 to deliver the target power level to the heating element 142 exceeds the threshold percentage (e.g., duty cycle >100%).

The duty cycle of the modulated electrical signal that causes the target power level to be delivered from the power source 112 to the heating element 142 may be determined based at least on a current temperature of the heating element 142 and a target temperature of the heating element 142. For example, the current temperature of the heating element 142 may be determined based on one or more measurements associated with the heating element 142 including, for example, voltage, current, resistance, and/or the like. The controller 104 may determine, based at least on a magnitude of the difference between the current temperature of the heating element 142 and the target temperature for the heating element 142, the target power level that is required for achieving the target temperature, for example, within a threshold period of time. Moreover, the controller 104 may determine, based at least on the target power level, the duty cycle of the modulated electrical signal that causes the target power level to be delivered from the power source 112 to the heating element 142.

Figure 2:
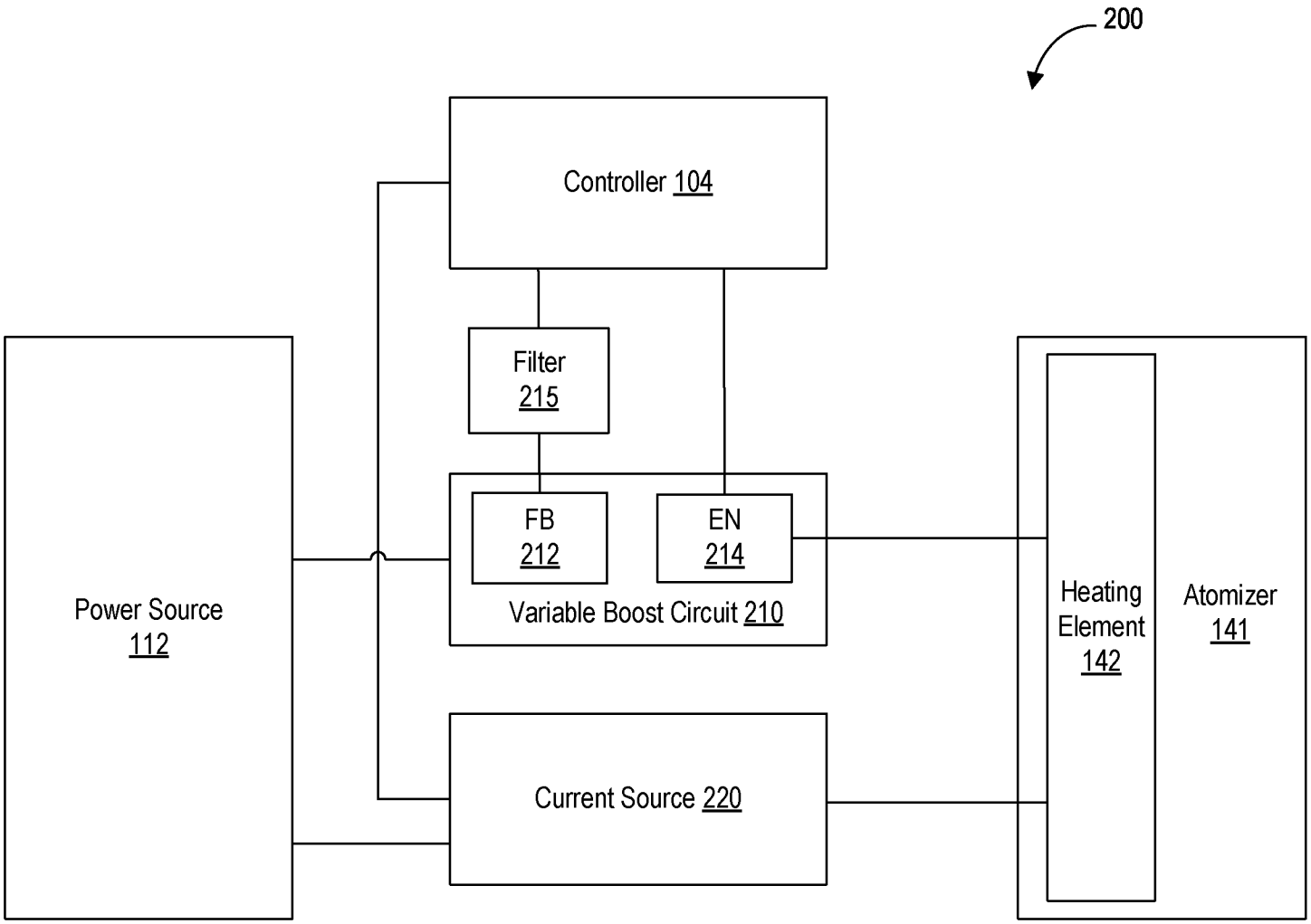
FIG. 2 depicts a block diagram illustrating an example of a circuit for delivering power to a heating element in a vaporizer device consistent with implementations of the current subject matter.

To further illustrate, FIG. 2 depicts a block diagram illustrating an example of a circuit 200 for delivering power to the heating element 142 in the vaporizer device 100 consistent with implementations of the current subject matter. Referring to FIGS. 1A-B and 2, the circuit 200 may include a variable boost circuit 210 and a current source 220. As shown in FIG. 2, the variable boost circuit 210 and the current source 220 may be coupled to the power source 112 as well as the controller 104. According to some implementations of the current subject matter, the controller 104 may be configured to control the discharge of the power source 112 to the heating element 142 in the atomizer 141 including by controlling whether the variable boost circuit 210 operates in a bypass mode or a non-bypass mode.

In some implementations of the current subject matter, when the variable boost circuit 210 is operating in the non-bypass mode, the variable boost circuit 210 may increase a voltage of the power source 112 (e.g., a battery and/or the like) to provide, to the heating element 142, a variable output voltage that corresponds to the resistance (e.g., direct current resistance) and the power requirement of the heating element 142. Alternatively, when the variable boost circuit 210 is operating in the bypass mode, the variable boost circuit 210 may provide, to the heating element 142, an output voltage that corresponds to the voltage of the power source 112. For example, while in the bypass mode, the variable boost circuit 210 may generate a first output voltage that is approximately the same as the voltage of the power source 112. However, the first output voltage may not equal the voltage of the power source 112 due to resistive losses. In the non-bypass mode, the variable boost circuit 210 may generate at least a second output voltage and a third output voltage that are greater than the voltage of the power source 112. To generate the second output voltage and the third output voltage, the variable boost circuit 210 in the non-bypass mode may step up the voltage of the power source 112 while stepping down the current discharged to the heating element 142. Doing so may minimize the dissipation of power before power from the power source 112 reaches the heating element 142.

Referring again to FIG. 2, the variable boost circuit 210 may include a feedback node 212 and an enable node 214. Operations of the variable boost circuit 210 may be controlled by control signals applied at the feedback node 212 and/or the enable node 214. For example, as noted, the controller 104 may adjust, based at least in part on the resistance and/or the power requirement of the heating element 142, the output voltage of the variable boost circuit 210. In order to adjust the output voltage of the variable boost circuit 210, the controller 104 may generate a first control signal, which may be applied at the feedback node 212 to effect a corresponding increase (or decrease) in the output voltage of the variable boost circuit 210.

In some implementations of the current subject matter, the first control signal may be a modulated control signal (e.g., a 1-megahertz (or different frequency) pulse width modulated (PWM) signal and/or the like) whose duty cycle may be adjusted by the controller 104 in order to vary to the output voltage of the variable boost circuit 210. As shown in FIG. 2, the first control signal from the controller 104 may pass through a filter 215 before being applied at the feedback node 212. The filter 215 may be a low pass filter such as, for example, a resistor-capacitor (RC) circuit, a digital to analog converter (DAC), a high order active low pass circuit, and/or the like. Accordingly, the filter 215 may be configured to pass, to the feedback node 212, the first control signal if the frequency of the first control signal is below a threshold value but attenuate the first control signal if the frequency of the first control signal exceeds the threshold value.

The variable boost circuit 210 may be configured to adjust, based at least on the voltage at the feedback node 212, the output voltage of the variable boost circuit 210. In some implementations, the duty cycle of the first control signal, which is applied at the feedback node 212 of the variable boost circuit 210, may be inversely proportional to the output voltage of the variable boost circuit 210 triggered by the first control signal. For example, the controller 104 may increase the duty cycle of the first control signal in order to trigger, at the variable boost circuit 210, a reduction in the output voltage of the variable boost circuit 210. Alternatively, the controller 104 may decrease the duty cycle of the first control signal in order to trigger, at the variable boost circuit 210, an increase in the output voltage of the variable boost circuit 210.

In some implementations of the current subject matter, the output voltage of the variable boost circuit 210 may be reduced, for example, by increasing the duty cycle of the first control signal, when the controller 104 determines that the resistance and/or the power requirement of the heating element 142 is low. Alternatively, the output voltage of the variable boost circuit 210 may be increased, for example, by decreasing the duty cycle of the first control signal, when the controller 104 determines that the resistance and/or the power requirement of the heating element 142 is high. In doing so, the controller 104 may ensure that the variable boost circuit 210 delivers, to the heating element 142, a power level that corresponds to the power requirement and/or the resistance of the heating element 142. For example, the controller 104 may decrease the output voltage of the variable boost circuit 210 to prevent delivering excess power to the heating element 142 and increase the output voltage of the variable boost circuit 210 to avoid delivering inadequate power to the heating element 142.

In some implementations of the current subject matter, the controller 104, may determine whether to operate the variable boost circuit 210 in the bypass mode or the non-bypass mode based on a duty cycle of the modulated electrical signal that causes a target power level to be delivered from the power source 112 to the heating element 142. For example, the controller 104 may determine to operate the variable boost circuit 210 in the bypass mode if the duty cycle of the modulated electrical signal causing the power source 112 to deliver the target power level to the heating element 142 does not exceed a threshold percentage (e.g., duty cycle ≤100%). That is, the controller 104 may determine to operate the variable boost circuit 210 in the bypass mode if the output voltage of the power source 112 is sufficient to achieve the target power level without being stepped up by the variable boost circuit 210. Alternatively, the controller 104 may determine to operate the variable boost circuit 210 in the non-bypass mode if the duty cycle of the modulated electrical signal causing the power source 112 to deliver the target power level to the heating element 142 exceeds the threshold percentage (e.g., duty cycle >100%). For instance, the controller 104 may determine to operate the variable boost circuit 210 in the non-bypass mode if the output voltage of the power source 112 is insufficient to achieve the target power level without being stepped up by the variable boost circuit 210.

The duty cycle of the modulated electrical signal causing the target power level to be delivered from the power source 112 to the heating element 142 may be determined based at least on a current temperature of the heating element 142 and a target temperature of the heating element 142. For example, the current temperature of the heating element 142 may be determined based on one or more measurements associated with the heating element 142 including, for example, voltage, current, resistance, and/or the like. The controller 104 may determine, based at least on a magnitude of the difference between the current temperature of the heating element 142 and the target temperature for the heating element 142, the target power level that is required for achieving the target temperature, for example, within a threshold period of time. Moreover, the controller 104 may determine, based at least on the target power level, the duty cycle of the modulated electrical signal that causes the target power level to be delivered from the power source 112 to the heating element 142.

In some implementations of the current subject matter, the controller 104 may disable the variable boost circuit 210 in order to perform one or more measurements at the heating element 142 and determine, for example, the current temperature of the heating element 142. For instance, in the example of the variable boost circuit 210 shown in FIG. 2, the controller 104 may disable (and enable) the variable boost circuit 210 by at least applying a second control signal at the enable node 214 of the variable boost circuit 210. While the variable boost circuit 210 is disabled, a current having a known magnitude I from the current source 220 may be applied across the heating element 142. The resistance R across the heating element 142 may be determined based at least in part on the magnitude of the current across the heating element 142 and the resulting voltage V that is measured across heating element 142 (e.g., R=V/I). Moreover, the current temperature of the heating element 142 may correspond to the resistance across the heating element 142 and a temperature coefficient of resistance associated with the heating element 142.

Figure 3:
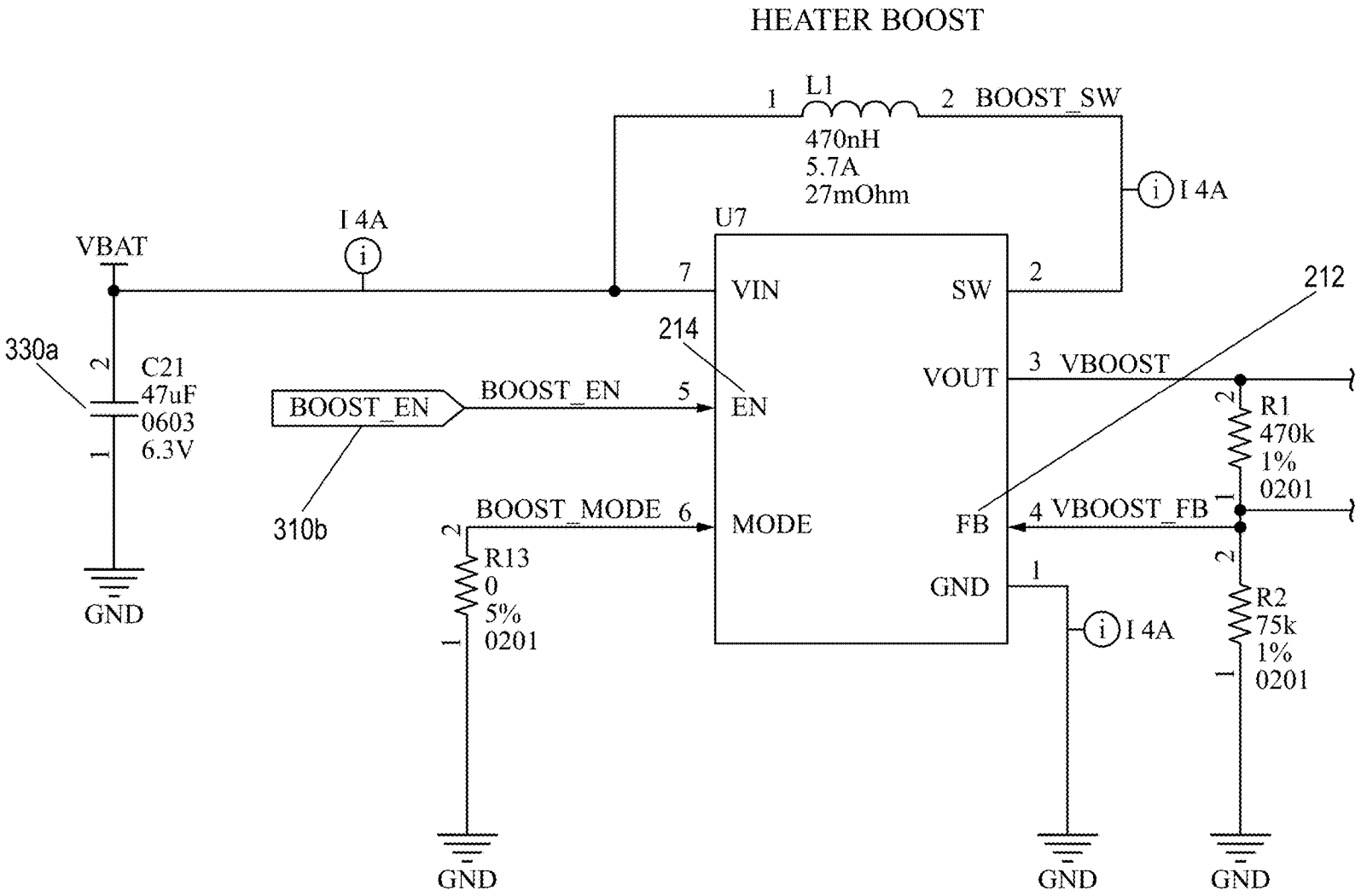
FIG. 3 depicts a schematic diagram illustrating an example of a variable boost circuit consistent with implementations of the current subject matter.
Figure 3:
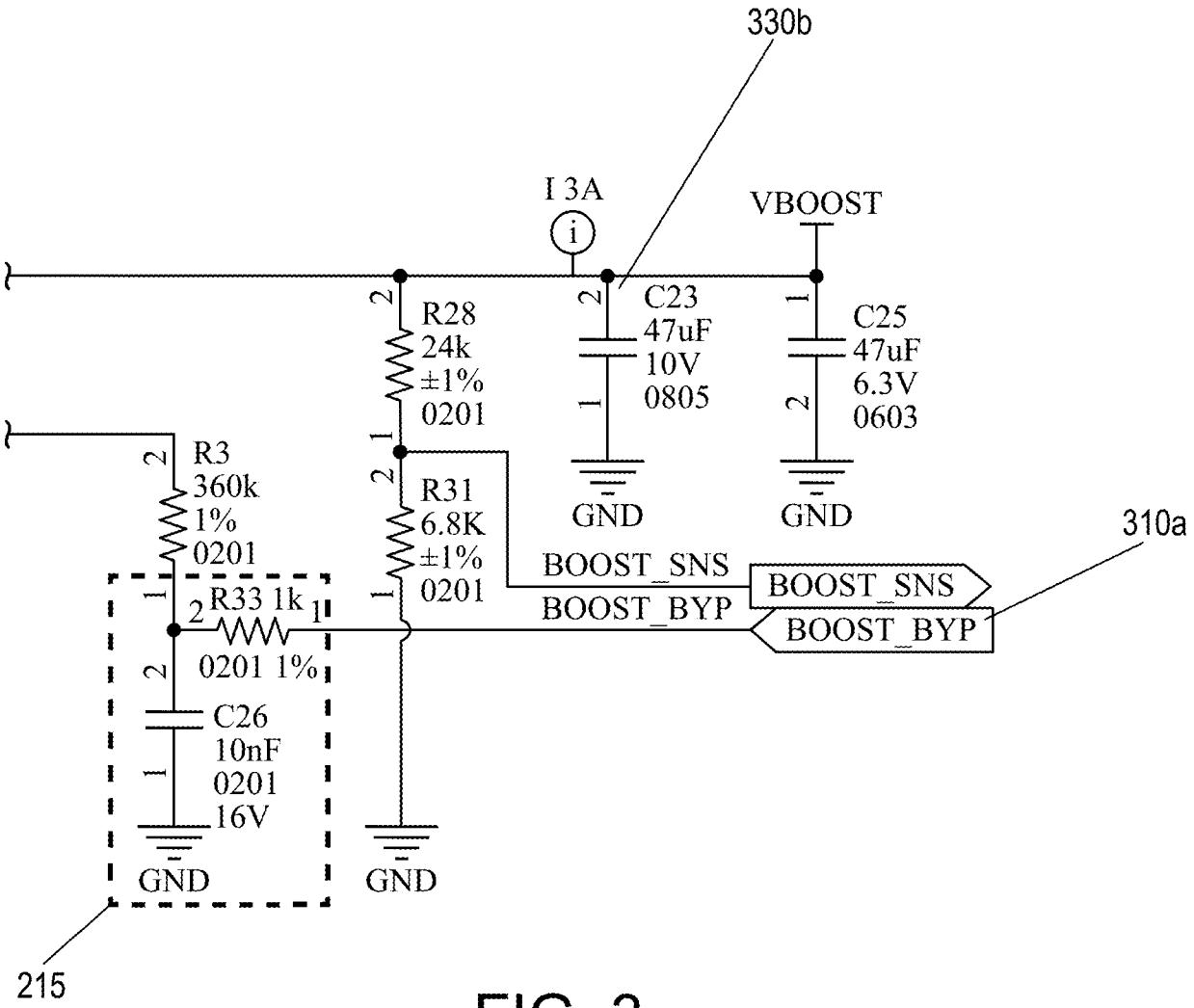

FIG. 3 depicts a schematic diagram illustrating an example of the variable boost circuit 210 consistent with implementations of the current subject matter. Referring to FIG. 3, at least a portion of the circuitry implementing the variable boost circuit 210 may be part of an integrated circuit disposed on a printed circuit board assembly (PCBA).

As shown in FIG. 3, the variable boost circuit 210 may receive a first input signal 310*a* (e.g. BOOST_BYP), which may be generated by the controller 104 to adjust the output voltage of the variable boost circuit 210. As shown in FIGS. 2-3, the first input signal 310*a* may pass through the filter 215 (e.g., a low-pass filter and/or the like) before being applied at the feedback node 212 of the variable boost circuit 210. Moreover, the controller 104 may adjust the duty cycle of the first control signal 310*a* in order to vary to the output voltage of the variable boost circuit 210. For example, the duty cycle of the first control signal 310*a* may be adjusted in order to place the variable boost circuit 210 in a bypass mode in which the variable boost circuit 210 generates a first output voltage that corresponds to the voltage of the power source 112. Alternatively and/or additionally, the duty cycle of the first control signal 310*a* may be adjusted in order to place the variable boost circuit 210 in a non-bypass mode in which the variable boost circuit 210 generates at least a second output voltage and/or a third output voltage that are each greater than the voltage of the power source 112.

Referring again to FIG. 3, the variable boost circuit 210 may further receive a second input signal 310*b* (e.g., BOOST_EN) corresponding to the second control signal generated by the controller 104 and applied at the enable node 214 of the variable boost circuit 210 in order to disable (or enable) the variable boost circuit 210. As noted, the controller 104 may disable the variable boost circuit 210 in order to perform one or more measurements at the heating element 142 and determine, for example, the current temperature of the heating element 142. Accordingly, the second input signal 310*b* (e.g., BOOST_EN) may be low while one or more measurements are being performed at the heating element 142. However, the second input signal 310*b* may remain high when the variable boost circuit 210 is powering the heating element 142 in either the bypass mode or the non-bypass mode.

Referring again to FIG. 3, the variable boost circuit 210 may receive, at $V_{IN}$, an input voltage corresponding to an output voltage $V_{BAT}$ of the power source 112 (e.g., a battery and/or the like). Moreover, the variable boost circuit 210 may provide, at $V_{out}$, an output voltage $V_{BOOST}$ that may be adjusted based at least in part on a power requirement and/or a resistance of the heating element 142. According to some implementations of the current subject matter, the output voltage $V_{BOOST}$ of the variable boost circuit 210 may be adjusted based at least on the duty cycle of the first input signal 310*a* received from the controller 104. For example, the output voltage $V_{BOOST}$ of the variable boost circuit 210 may increase in response to a decrease in the duty cycle of the first input signal 310*a*. Alternatively, the output voltage $V_{BOOST}$ of the variable boost circuit 210 may decrease in response to an increase in the duty cycle of the first input signal 310*a*. Moreover, when the variable boost circuit 210 is in the bypass mode, the output voltage $V_{BOOST}$ of the variable boost circuit 210 may be adjusted, in accordance with the duty cycle of the first input signal 310*a* (e.g., BOOST_BYP), to be approximately the same as the output voltage $V_{BAT}$ of the power source 112. Contrastingly, when the variable boost circuit 210 is in the non-bypass mode, the output voltage $V_{BOOST}$ of the variable boost circuit 210 may be adjusted, in accordance with the duty cycle of the first input signal 310*a*, to one or more output voltages that are greater than the output voltage $V_{BAT}$ of the power source 112.

In some implementations of the current subject matter, the variable boost circuit 210 may be coupled to an input capacitor 330*a* and/or an output capacitor 330*b* in order to reduce and/or eliminate noise at the input $V_{IN}$ and/or the output $V_{OUT}$ of the variable boost circuit 210. The input capacitor 330*a* and/or the output capacitor 330*b* may have a small capacitance (e.g., a non-polarized capacitor and/or the like) in order to filter out high frequency noise at the input $V_{IN}$ and/or the output $V_{OUT}$ of the variable boost circuit 210. Alternatively and/or additionally, the input capacitor 330*a* and/or the output capacitor 330*b* may have a large capacitance (e.g., an electrolytic capacitor and/or the like) in order to filter out low frequency noise at the input $V_{IN}$ and/or the output $V_{OUT}$ of the variable boost circuit 210.

Figure 4:
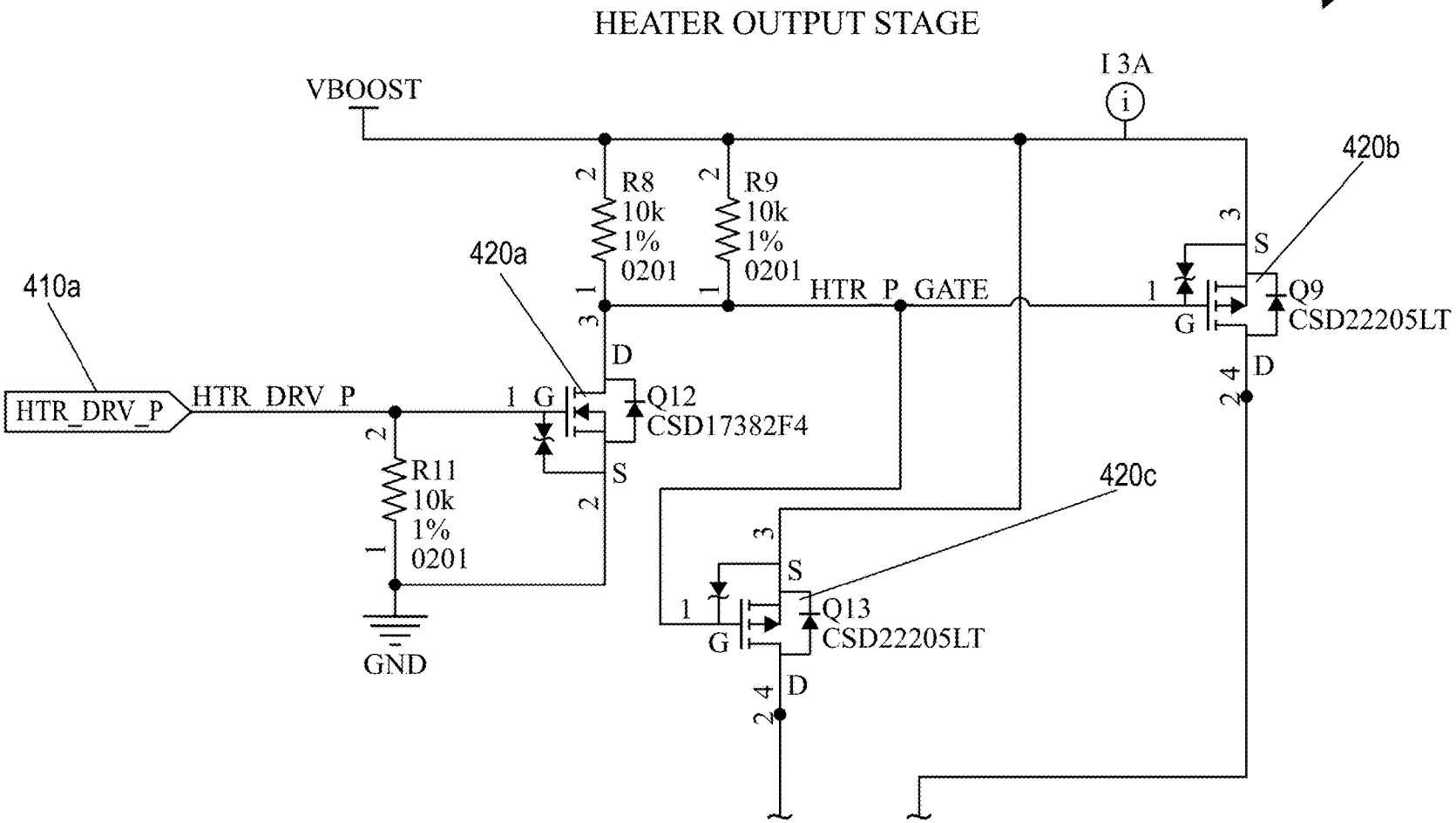
FIG. 4 depicts a schematic diagram illustrating an example of an output stage of a heating element consistent with implementations of the current subject matter.
Figure 4:
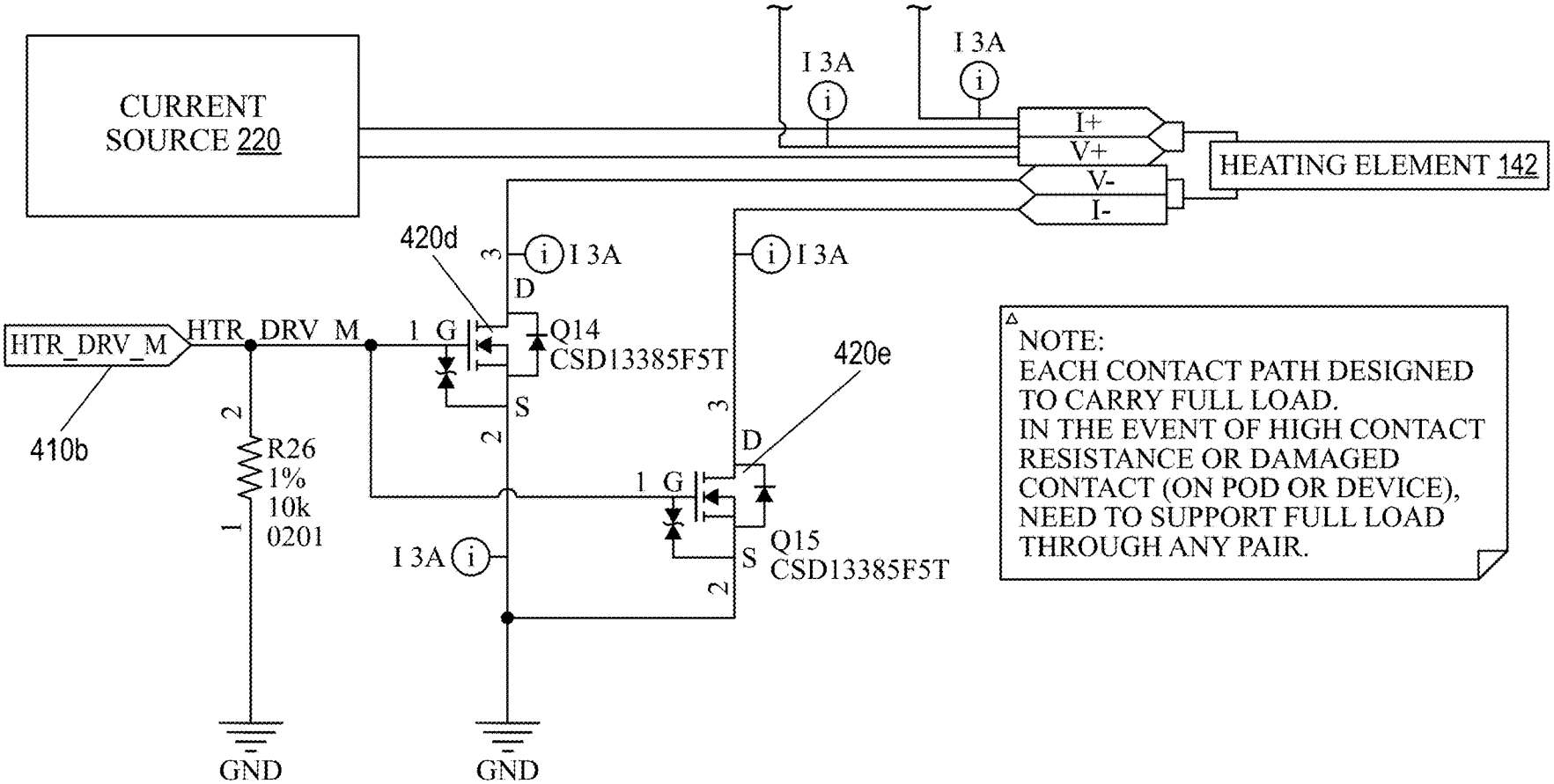

FIG. 4 depicts a schematic diagram illustrating an example of an output stage 400 of the heating element 142 consistent with implementations of the current subject matter. Referring to FIGS. 1-4, the output stage 400 of the heating element 142 may include one or more transistors 420 controlled by a first control signal 410*a* (e.g., HTR_DRV_P) and a second control signal 410*b* (e.g., HTR_DRV_M). The one or more transistors 420 may include, for example, a first transistor 420*a*, a second transistor 420*b*, a third transistor 420*c*, a fourth transistor 420*d*, and a fifth transistor 420*e*. Moreover, the one or more transistors 420 may be field effect transistors such as, for example, metal-oxide semiconductor field-effect transistors (MOSFET), junction field effect transistors (JFET), and/or the like.

As noted, the controller 104 may determine to operate the variable boost circuit 210 in a non-bypass mode when the duty cycle of the modulated electrical signal causing a target power level to be delivered from the power source 112 to the heating element 142 exceeds a threshold percentage (e.g., duty cycle >100%). This may occur, for example, when the output voltage $V_{BAT}$ of the power source 112 is insufficient to achieve the target power level. While the variable boost circuit 210 is in the non-bypass mode, the output voltage $V_{BOOST}$ of the variable boost circuit 210 may be greater than the output voltage $V_{BAT}$ of the power source 112. Moreover, the first control signal 410*a* (e.g., HTR_DRV_P) and the second control signal 410*b* (e.g., HTR_DRV_M) may be held high such that the variable boost circuit 210 provides a constant output voltage $V_{BOOST}$ to the heating element 142. For example, holding the first control signal 410*a* (e.g., HTR_DRV_P) high and the second control signal 410*b* (e.g., HTR_DRV_M) high may change the states of the one or more transistors 420 such that the output voltage $V_{BOOST}$ of the variable boost circuit 210, which is greater than the output voltage $V_{BAT}$ of the power source 112, is applied at the heating element 142.

Alternatively, the controller 104 may determine to operate the variable boost circuit 210 in a bypass mode when the duty cycle of the modulated electrical signal causing a target power level to be delivered from the power source 112 to the heating element 142 does not exceed a threshold percentage (e.g., duty cycle ≤100%). As noted, the variable boost circuit 210 may operate in the bypass mode when the output voltage $V_{BAT}$ of the power source 112 is sufficient to achieve the target power level. While the variable boost circuit 210 is in the bypass mode, the output voltage $V_{BOOST}$ of the variable boost circuit 210 may correspond to the output voltage $V_{BAT}$ of the power source 112. Moreover, while the first control signal 410*a* (e.g., HEATER_DRV_P) is held high, the controller 104 may adjust the duty cycle of the second control signal 410*b* (e.g., HEATER_DRV_M) such that the duty cycle of the second control signal 410*b* corresponds to the duty cycle causing the target power level to be delivered from the power source 112 to the heating element 142. In doing so, the output voltage $V_{BOOST}$ of the variable boost circuit 210, which may correspond to the output voltage $V_{BAT}$ of the power source 112, may be applied at the heating element 142 at the duty cycle required to deliver the target power level to the heating element 142.

Figure 5:
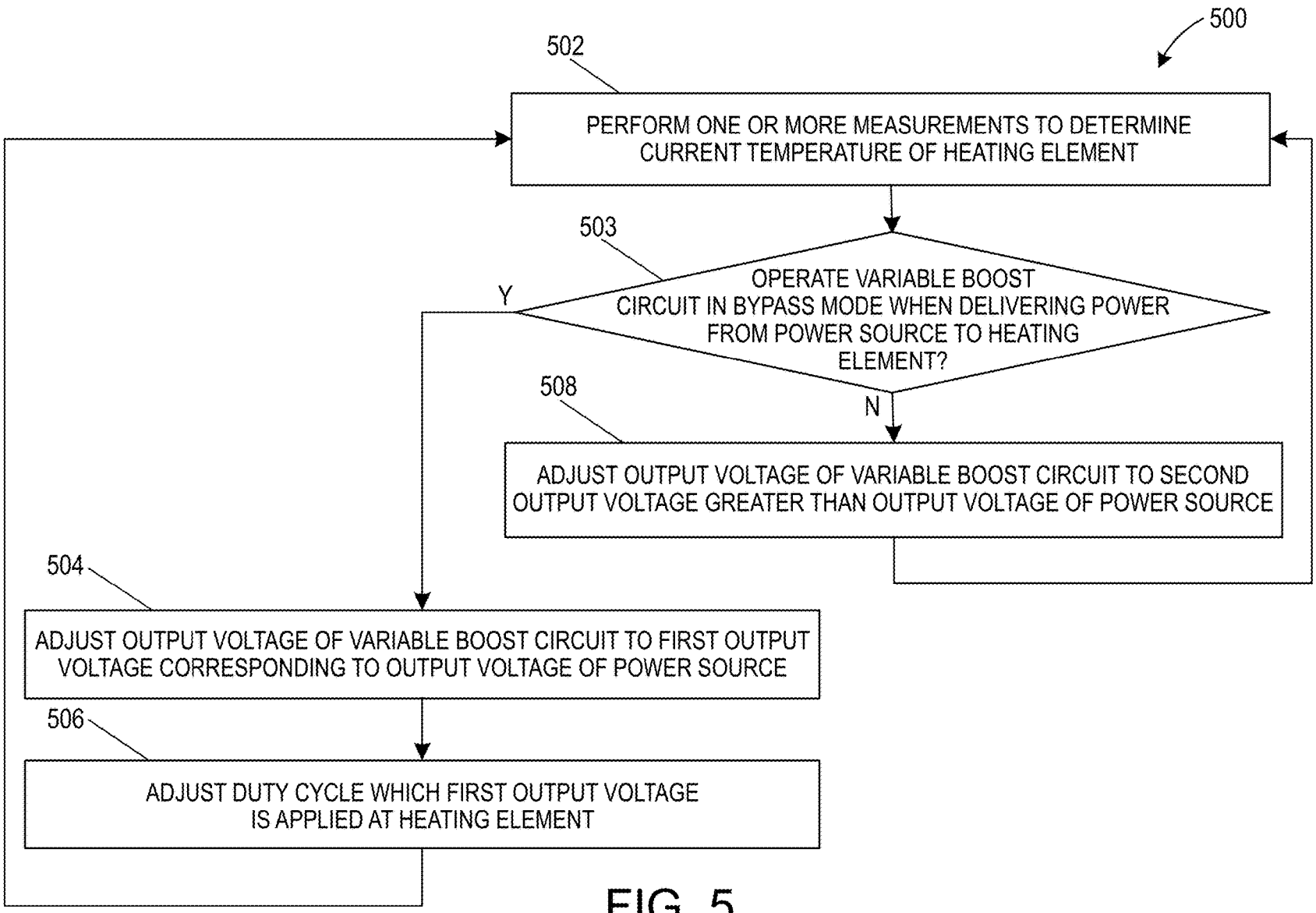
FIG. 5 depicts a flowchart illustrating an example of a method for controlling the delivery of power to a heating element in a vaporizer device consistent with implementations of the current subject matter.

FIG. 5 depicts a flowchart illustrating an example of a method 500 for controlling the delivery of power to a heating element in a vaporizer device consistent with implementations of the current subject matter. Referring to FIGS. 1A-1B and 2-5, the method 500 may be performed, for example, by the controller 104 in order to control the delivery of power to the heating element 142. As noted, power from the power source 112 may be delivered to the heating element 142 in order to increase the temperature of the heating element 142 to a suitable temperature for vaporizing at least a portion of the vaporizable material 102 drawn into the wicking element. The delivery of power to the heating element 142 may be triggered when one or more puffs are detected at the vaporizer device 100, for example, by the one or more sensors 113.

The controller 104 may perform one or more measurements to determine a current temperature of the heating element 142 (502). For example, the controller 104 may measure a resistance, a voltage, and/or a current of the heating element 142. As noted, the resistance of the heating element 142 may be determined based at least on the current through and the voltage across the heating element 142. Moreover, the current temperature of the heating element 142 may be determined based at least in part on the resistance of the heating element 142 and a temperature coefficient of resistance associated with the heating element 142.

The controller 104 may determine, based at least on the current temperature of the heating element 142, whether to operate the variable boost circuit 210 in the bypass mode when delivering power from the power source 112 to the heating element 142 (503). In some implementations of the current subject matter, the controller 104 may disable the variable boost circuit 210 in order to perform one or more measurements at the heating element 142 and determine the current temperature of the heating element 142. For instance, while the variable boost circuit 210 is disabled, a current having a known magnitude I from the current source 220 may be applied across the heating element 142. The resistance R across the heating element 142 may be determined based at least in part on the magnitude of the current across the heating element 142 and the resulting voltage V that is measured across heating element 142 (e.g., R=V/I). Moreover, the current temperature of the heating element 142 may correspond to the resistance of across the heating element 142 and a temperature coefficient of resistance associated with the heating element 142.

The controller 104 may determine to operate the variable boost circuit 210 in the bypass mode (503-Y). In some implementations of the current subject matter, the controller 104 may determine to operate the variable boost circuit 210 in the bypass mode when the duty cycle of the modulated electrical signal causing the power source 112 to deliver the target power level to the heating element 142 does not exceed the threshold percentage (e.g., duty cycle ≤100%). While the variable boost circuit 210 is in the bypass mode, the output voltage $V_{BOOST}$ of the variable boost circuit 210 may be approximately the same as the output voltage $V_{BAT}$ of the power source 112. It should be appreciated that the controller 104 may operate the variable boost circuit 210 in the bypass mode in order to achieve a smaller and/or more granular increase in the temperature of the heating element 142. Alternatively and/or additionally, the controller 104 may operate the variable boost circuit 210 in the bypass mode if the controller 104 determines that the modulated electrical signal from the power source 212 is sufficient to achieve the target temperature at a required rate and/or within the threshold quantity of time.

In response to determining to operate the variable boost circuit 210 in the bypass mode, the controller 104 may adjust the output voltage of the variable boost circuit 210 to a first output voltage corresponding to the output voltage of the power source 112 (504). For example, the controller 104 may adjust a duty cycle of the first control signal 310*a* applied at the feedback node 212 of the variable boost circuit 210 such that the output voltage $V_{BOOST}$ of the variable boost circuit 210 equals the output voltage $V_{BAT}$ of the power source 112.

Furthermore, the controller 104 may adjust a duty cycle at which the first output voltage is applied at the heating element 142 (506). As noted, the variable boost circuit 210 may operate in the bypass mode when the output voltage $V_{BAT}$ of the power source 112 is sufficient to achieve the target power level. While the variable boost circuit 210 is in the bypass mode, the output voltage $V_{BOOST}$ of the variable boost circuit 210 may be approximately the same as the output voltage $V_{BAT}$ of the power source 112. Moreover, the controller 104 may adjust the duty cycle of the second control signal 410*b* (e.g., HTR_DRV_M) such that the duty cycle of the second control signal 410*b* corresponds to the duty cycle of the modulated electrical signal causing the target power level to be delivered from the power source 112 to the heating element 142. By adjusting the duty cycle of the second control signal 410*b*, the output voltage $V_{BOOST}$ of the variable boost circuit 210, which may correspond to the output voltage $V_{BAT}$ of the power source 112, may be applied at the heating element 142 at the duty cycle required to deliver the target power level to the heating element 142. Upon adjusting the duty cycle at which the output voltage $V_{BOOST}$ of the variable boost circuit 210 is applied at the heating element 142, the process 500 may resume at operation 502, where the controller 104 again performs one or more measurements to determine a current temperature of the heating element 142.

Alternatively, the controller 104 may determine, based at least on the current temperature of the heating element 142, to operate the variable boost circuit 210 in a non-bypass mode (503—N). In some implementations of the current subject matter, the controller 104 may determine to operate the variable boost circuit in the non-bypass mode if the duty cycle of the modulated electrical signal causing the target power level to be delivered from the power source 112 to the heating element 142 exceeds the threshold percentage (e.g., duty cycle >100%). For example, the target power level that is required to achieve a target temperature at the heating element 142 may be determined based at least on a magnitude of the difference between the current temperature of the heating element 142 and the target temperature for the heating element 142. Moreover, the controller 104 may determine, based at least on the target power level, the duty cycle of the modulated electrical signal causing the target power level to be delivered from the power source 112 to the heating element 142. It should be appreciated that the controller 104 may operate the variable boost circuit 210 in the non-bypass mode in order to achieve a larger or less granular increase in the temperature of the heating element 142 (e.g., when the magnitude of the difference between the current temperature and the target temperature of the heating element 142 exceeds a threshold value). Alternatively and/or additionally, the controller 104 may operate the variable boost circuit 210 in the non-bypass mode in order to achieve the target temperature more rapidly and/or within a threshold quantity of time.

Accordingly, the controller 104 may adjust the output voltage of the variable boost circuit to a second output voltage greater than the output voltage of the power source 112 (508). In some implementations of the current subject matter, the controller 104 may adjust the output voltage $V_{BOOST}$ of the variable boost circuit 210 by at least adjusting a duty cycle of the first control signal 310*a* applied at the feedback node 212 of the variable boost circuit 210. The duty cycle of the first control signal 310*a* may be inversely proportional to the output voltage $V_{BOOST}$ of the variable boost circuit 210. While in the non-bypass mode, the controller 104 may adjust the duty cycle of the first control signal 310*a* such that the output voltage $V_{BOOST}$ of the variable boost circuit 210 is greater than the output voltage $V_{BAT}$ of the power source 112. Moreover, the output voltage $V_{BOOST}$ of the variable boost circuit 210 may be adjusted to prevent delivering excess power and/or inadequate power to the heating element 142. Upon adjusting the output voltage $V_{BOOST}$ of the variable boost circuit 210, the process 500 may resume at operation 502 where the controller 104 performs one or more measurements to determine a current temperature of the heating element 142.

Terminology

When a feature or element is herein referred to as being "on" another feature or element, it can be directly on the other feature or element or intervening features and/or elements can also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements can be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature can have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device can be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers can be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value can have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes can be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on," herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A vaporizer device, comprising:

a power source;

a variable boost circuit having a bypass mode and a non-bypass mode, the variable boost circuit in the bypass mode configured to deliver power from the power source to a heating element by generating a first output voltage corresponding to a voltage of the power source, the variable boost circuit in the non-bypass mode configured to deliver power from the power source to the heating element by generating a second output voltage that is greater than the voltage of the power source, the delivery of power to the heating element increasing a temperature of the heating element to a target temperature for vaporizing a vaporizable material, wherein the variable boost circuit comprises a feedback circuit configured to receive a feedback signal, and wherein the variable boost circuit is configured to adjust the second output voltage based on the feedback signal; and a controller configured to:

determine, based at least on one or more measurements associated with the heating element, whether to operate the variable boost circuit in the bypass mode or the non-bypass mode;

adjust, when operating the variable boost circuit in the bypass mode, a first duty cycle at which the first output voltage is applied at the heating element;

generate, when operating the variable boost circuit in the non-bypass mode, a control signal, wherein the feedback signal is applied to the feedback circuit based on the control signal and the second output voltage; and adjust a second duty cycle of the control signal to increase or decrease the second output voltage, wherein the first duty cycle at which the first output voltage is applied to the heating element is associated with a first path that is separate from a second path associated with the second duty cycle of the control signal.

2. The vaporizer device of claim 1, wherein the controller determines, based at least on the first duty cycle at which the first output voltage is applied at the heating element, whether to operate the variable boost circuit in the bypass mode or the non-bypass mode.

3. The vaporizer device of claim 2, wherein the controller determines to operate the variable boost circuit in the non-bypass mode when the first duty cycle exceeds a threshold percentage, and wherein the controller determines to operate the variable boost circuit in the bypass mode when the first duty cycle does not exceed the threshold percentage.

4. The vaporizer device of claim 2, wherein the controller is configured to determine, based at least on a difference between a current temperature of the heating element and the target temperature of the heating element, the target power level, and wherein the controller is further configured to determine, based at least on the target power level, the first duty cycle at which the first output voltage is applied at the heating element.

5. The vaporizer device of claim 4, wherein the vaporizer further comprises a current source configured to provide, to the heating element, the current having a known magnitude, wherein the controller is further configured to determine, based at least on a resistance of the heating element, the current temperature of the heating element, wherein the resistance is determined by applying the current having the known magnitude from the current source across the heating element, and measuring a resultant voltage.

6. The vaporizer device of claim 5, wherein the controller is further configured to disable the variable boost circuit while performing the one or more measurements to determine the magnitude of the current applied across the heating element and/or the voltage across the heating element.

7. The vaporizer device of claim 1, wherein the controller is further configured to generate a second control signal to place the variable boost circuit in the bypass mode or the non-bypass mode based on the first duty cycle.

8. The vaporizer device of claim 1, wherein the control signal comprises a pulse width modulated (PWM) signal applied at the feedback circuit of the variable boost circuit, and wherein the controller adjusts the second output voltage of the variable boost circuit by at least adjusting the second duty cycle of the control signal.

9. The vaporizer device of claim 8, wherein the control signal is inversely proportional to the second output voltage of the variable boost circuit.

10. The vaporizer device of claim 9, wherein the control signal is passed through a low-pass filter before being applied at the feedback circuit.

11. The vaporizer device of claim 1, wherein the variable boost circuit in the non-bypass mode is further configured to deliver power from the power source to the heating element by generating, based on the control signal, a third output voltage greater than the voltage of the power source.

12. The vaporizer device of claim 1, wherein the first path comprises a path for current between the heating element and a current source, and wherein the second path comprises a path for current between the feedback circuit and the controller.

13. The vaporizer device of claim 12, wherein the second path further comprises a filter configured to:

pass, when a frequency of the control signal is below a threshold value, the control signal to the feedback circuit; and attenuate, when the frequency of the control signal exceeds the threshold value, the control signal.

14. A method, comprising:

determining, based at least on one or more measurements associated with a heating element of a vaporizer device, whether to operate a variable boost circuit in the vaporizer device in a bypass mode or a non-bypass mode;

delivering, by the variable boost circuit when operating in the bypass mode, power from a power source in the vaporizer device to the heating element by generating a first output voltage corresponding to a voltage of the power source;

delivering, by the variable boost circuit when operating in the non-bypass mode, power from the power source to the heating element by generating a second output voltage that is greater than the voltage of the power source, the delivery of power to the heating element increasing a temperature of the heating element to a target temperature for vaporizing a vaporizable material;

adjusting, when operating the variable boost circuit in the bypass mode, a first duty cycle at which the first output voltage is applied at the heating element;

generating, when operating the variable boost circuit in the non-bypass mode, a control signal;

applying, based on the control signal and the second output voltage, a feedback signal to a feedback circuit of the variable boost circuit; and adjusting, by the variable boost circuit, the second output voltage based on the feedback signal; and adjusting, when operating the variable boost circuit in the non-bypass mode, a second duty cycle of the control signal to increase or decrease the second output voltage, wherein the first duty cycle at which the first output voltage is applied to the heating element is associated with a first path that is separate from a second path associated with the second duty cycle of the control signal.

15. The method of claim 14, further comprising:

determining, based at least on the first duty cycle at which the first output voltage is applied at the heating element, whether to operate the variable boost circuit in the bypass mode or the non-bypass mode;

determining to operate the variable boost circuit in the non-bypass mode when the first duty cycle exceeds a threshold percentage; and determining to operate the variable boost circuit in the bypass mode when the first duty cycle does not exceed the threshold percentage.

16. The method of claim 15, further comprising:

providing, by a current source, a current having a known magnitude to the heating element;

determining, based at least on the known magnitude of the current applied across the heating element and a measured resultant voltage across the heating element when the current is applied across the heating element, a resistance of the heating element;

determining, based at least on the resistance of the heating element, a current temperature of the heating element;

determining, based at least on a difference between a current temperature of the heating element and the target temperature of the heating element, the target power level; and determining, based at least on the target power level, the first duty cycle at which the first output voltage is applied at the heating element.

17. The method of claim 14, further comprising:

generating a second control signal to place the variable boost circuit in the bypass mode or the non-bypass mode based on the first duty cycle, wherein the control signal comprises a pulse width modulated (PWM) signal applied at the feedback circuit of the variable boost circuit, and wherein the second output voltage of the variable boost circuit is adjusted by at least adjusting the second duty cycle of the control signal.

18. The method of claim 14, wherein the first path comprises a path for current between the heating element and a current source, and wherein the second path comprises a path for current between the feedback circuit and the controller.

19. The method claim 18, wherein the second path further comprises a filter configured to:

pass, when a frequency of the control signal is below a threshold value, the control signal to the feedback circuit; and attenuate, when the frequency of the control signal exceeds the threshold value, the control signal.

* * * * *